United States Patent [19]

Hubbert

[11] Patent Number: 4,493,641

[45] Date of Patent: Jan. 15, 1985

[54] BAKE OVEN WITH MANIFOLD

[75] Inventor: Gordon F. Hubbert, Plymouth, Mich.

[73] Assignee: Gladd Industries, Inc., Plymouth, Mich.

[21] Appl. No.: 569,500

[22] Filed: Jan. 9, 1984

[51] Int. Cl.[3] ..... F27B 9/00; F27B 3/22

[52] U.S. Cl. ..... 432/120; 432/144; 432/145; 432/148; 432/176

[58] Field of Search ..... 432/120, 144, 145, 146, 432/147, 148, 149, 150, 175, 176

[56] References Cited

U.S. PATENT DOCUMENTS

| | | | |
|---|---|---|---|
| 2,230,800 | 2/1941 | Hormel | 432/145 |
| 2,458,040 | 1/1949 | Weller | 432/145 |
| 2,917,299 | 12/1959 | Hess | 432/145 |
| 4,162,141 | 7/1979 | West | 432/144 |

*Primary Examiner*—John J. Camby

*Attorney, Agent, or Firm*—Reising, Ethington, Barnard, Perry & Milton

[57] ABSTRACT

A paint bake oven (10) including an outer insulated housing (12), the outer insulated housing having an inner wall surface (14). An inner housing (16) is disposed within the outer housing (12) and has an outer wall surface (18) spaced from the inner wall surface (14) to define a gas flow channel (20) therebetween. The inner housing (16) has an inner product passageway (22). A gas supply plenum (46) is disposed above the inner housings for supplying a gas flow to the gas flow channel (20). A gas exhaust passageway (38) exhausts gas from the product passageway (22). The oven (10) is characterized by including a manifold wall (28) for directing the gas flow along a flow path from the gas supply plenum (46) downwardly along the inner wall surface (20) of the outer housing (12) and then upwardly over the outer surface (18) of the inner housing (16) to uniformly distribute the gas flow over the inner housing (16).

17 Claims, 4 Drawing Figures

BAKE OVEN WITH MANIFOLD

TECHNICAL FIELD

This invention relates to a paint bake oven of the type conventionally used to bake products after painting in order to provide a hard and durable painted coating on the products.

BACKGROUND ART

Paint bake ovens are used to expose a freshly painted products, such as an automobile, to a heated environment to dry or cure the paint. The vehicle may be exposed to radiant heat wherein oven walls are heated by heated gas so that the heat radiates through the walls and into the product passageway of the oven. Alternatively, the vehicle may be subjected to convection heat wherein a heated gas flows directly into the product passageway. Several problems exist with these types of ovens. It is difficult to uniformly distribute the heat in the ovens. This can cause uneven curing of the paint. Control of the flow of the heated gases further disrupts the uniformity of heat within the product passageway of the oven. Further, prior art ovens use the heated gases inefficiently and are costly to operate. Prior art ovens that were made from housings having several parts are difficult and costly to ship and construct on site. Presently, convection type ovens now employed often cause currents within the products passageways of the ovens that lifted solids from the oven floor, contaminating the finish of the newly applied paint.

Applicant has provided improvements to the paint bake oven art as set forth in applicant's copending U.S. patent application Ser. No. 393,274, filed June 29, 1982, now abandoned and the continuing application thereof filed herewith, each of which discloses a paint bake oven having an inner housing, that inner housing having perforated walls to allow for the even distribution of low velocity gas flow therethrough. The oven comprises an outer housing and inner housing, the heated gas flowing between the housing walls through a gas flow passageway. The instant invention provides an additional feature for improving the gas flow through the gas flow passageway of the oven.

SUMMARY OF THE INVENTION

According to the present invention, there is provided a paint bake oven including an outer insulated housing having an inner wall surface and an inner housing disposed within the outer housing and having an outer wall surface spaced from the inner wall surface to define a gas flow channel therebetween. The inner housing has an inner product passageway. Gas supply means is disposed above the inner housing for supplying a gas flow to the gas flow channel. The oven further includes gas exhaust means for exhausting gas from the product passageway. The oven is characterized by gas flow control means for directing the gas flow along a flow path from the gas supply means downwardly along the inner wall surface of the outer housing and then upwardly over the outer wall surface of the inner housing to uniformly distribute the gas flow over the the inner housing.

FIGURES IN THE DRAWINGS

Other advantages of the present invention will be readily appreciated as the same becomes better understood by reference to the following detailed description when considered in connection with accompanying drawings wherein.

DETAILED DESCRIPTION OF THE DRAWINGS

Figure 2:
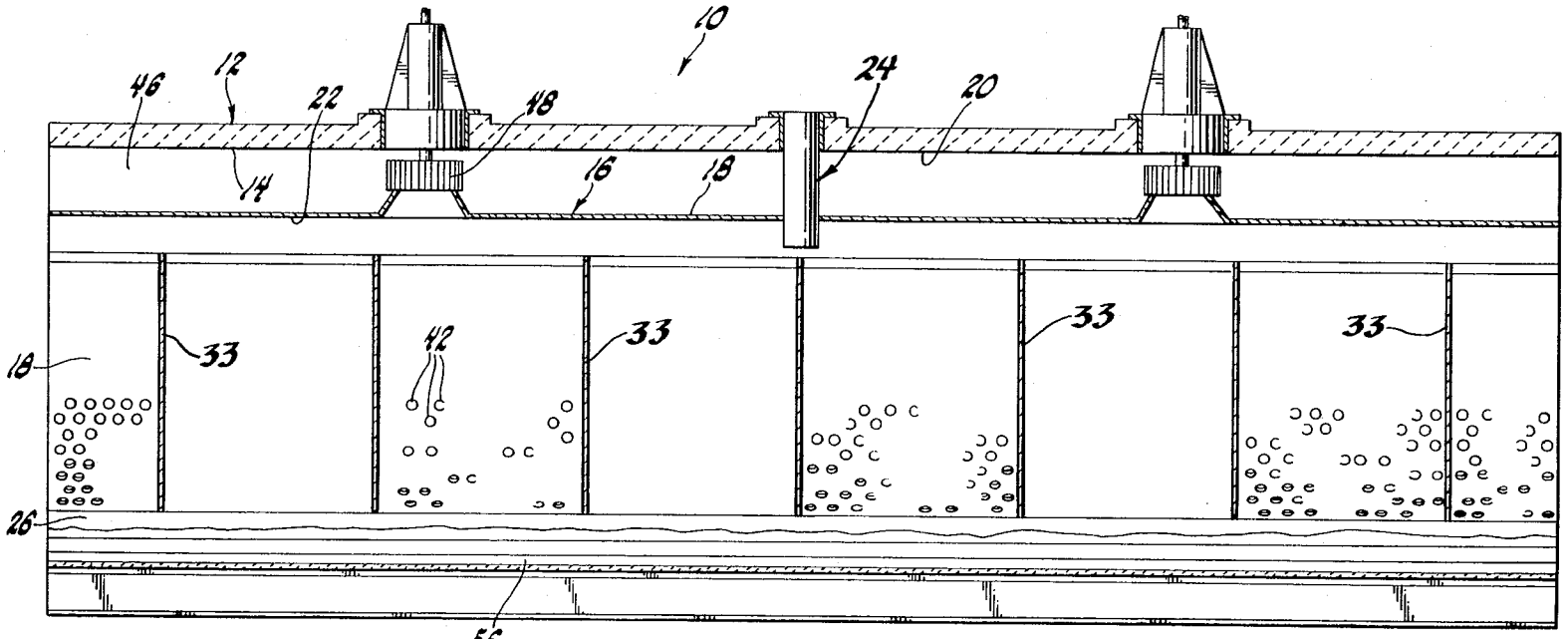
FIG. 2 is a cross sectional view taken substantially along lines 2—2 of FIG. 1.

Referring to the Figures, a paint bake oven constructed in accordance with the present invention is generally shown at 10 in the Figures. The oven 10 includes an outer insulated housing generally indicated at 12 including an inner wall surface 14. The outer housing 12 has an elongated shape as seen in FIG. 2 along the direction in which products are conveyed through the oven 10 from the left toward the right. An inner housing generally indicated at 16 is disposed within the outer housing 12 and has an outer wall surface 18 spaced from the inner wall surface 14 to define a gas flow channel 20 therebetween. The inner housing 16 has an inner product passageway 22 through which products are passed during baking within the oven 10. Gas supply means generally indicated at 24 is disposed above the inner housing 16 for supplying a gas flow to the gas flow channel 20. The gas supply means 24 may comprise a gas burner, electric heater, or steam heater. The oven 10 further includes gas exhaust means for exhausting gas from the product passageway 22. The assembly is characterized by gas flow control means for directing the gas flow along a path from the gas supply means 24 downwardly along the inner wall surface 14 of the outer housing 12 and then upwardly over the outer wall surface 18 of the inner housing 16 to uniformly distribute the gas flow over the inner housing 16. The gas flow control means provides greater uniformity of distribution of the heated gas along the inner housing 16 to more uniformly and effectively bake the product within the product passageway 22.

More specifically, the oven 10 includes a bottom wall 26 to define the bottom of the gas flow channel 20. The gas flow control means includes a manifold wall 28 within the gas flow channel 20 spaced from and between the inner wall surface 20 of the outer housing 12 and the outer wall surface 18 of the inner housing 16. The manifold wall 28 extends downwardly from the gas supply means 24 and has an end portion 30 spaced from the bottom wall 26 to define the flow path of gas through the gas flow channel 20. In prior art bake ovens, such as the oven disclosed in the aforesaid copending patent application, heat is generated in the oven from heated gas flowing from a gas supply means disposed above a gas flow channel as in the instant invention. However, the heated gas flows over the inner housing of the oven from above the inner housing and downwardly thereover. The instant invention provides the manifold wall 28 which controls the gas flow by directing it downwardly prior to the heated gas flow contacting the inner housing 16. The gas flow passes over the inner housing 16 by deflecting off the bottom wall 26 which is angled relative to the vertical so as to effectively and efficiently flow upward into the space between the manifold wall 28 and the outer surface 18 of the inner housing 16.

The oven 10 includes gating means for gating the flow of gas between the gas supply means 24 and the end portion 30 of the manifold wall 28. The gating means includes a plurality of gates or dampers 32 disposed between the manifold wall 28 and the inner wall surface 14 of the outer housing 12. The gates 32 are provided to vary the flow of heated gas through the chambered section of oven 10 and to also block off the gas flow path between the manifold wall 28 and inner wall surface 14 of the outer housing 12 to force the gas into the gas flow path between the manifold wall 28 and the inner housing 16. The gates 32 help regulate the low volume flow of heated gas to each chambered section through the oven 10. Prior art assemblies which direct high velocity hot air flow off the floor of an oven and then into the heating chamber thereof, carrying solid particulate matter from the floor into the baking chamber, and thereby possibly contaminating the baked article within the oven. Control of the gates 32 provides one means within the oven 10 for controlling the volume and distribution of the hot gas flow which can be increased or decreased in the multi chambered space 20.

Figure 4:
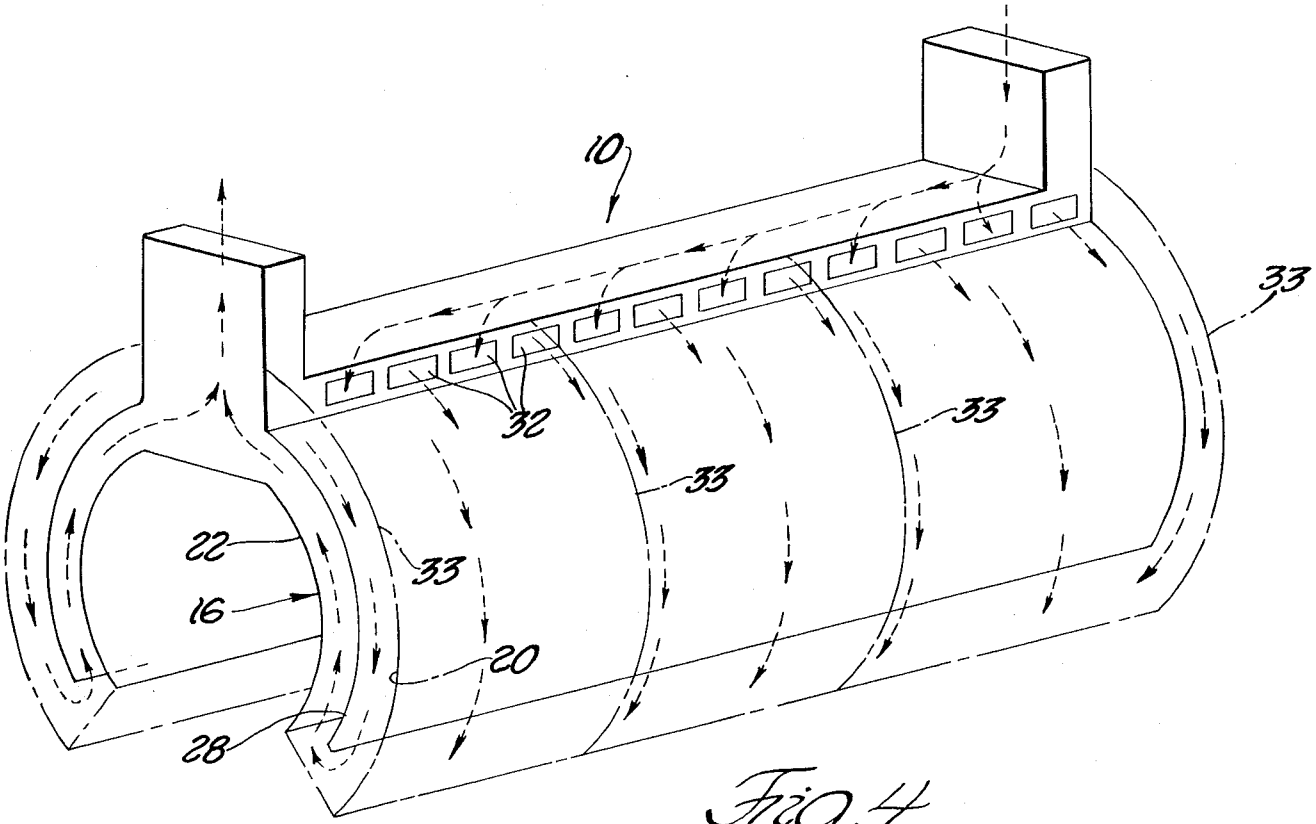
FIG. 4 is a schematic perspective view showing the flow path of gases through the invention.

The gating means may include a plurality of gates or dampers 32 disposed along the length of the module, as shown in FIG. 4. The assembly includes partitioning means for partitioning sections of the gas flow channel 20 along the length of the module to cut lines of radiation coming downwardly from the gates 32. The partitioning means includes a plurality of partitioning walls 33 extending completely across the gas flow channel 20 and from the gates 32 to the bottom wall 26 for partitioning the gas flow channel 20 into longitudinally separated sections. The partitioning walls 33 partition a module of an oven into separate sections. Control of the dampers or gates 32 controls the volume in each section defined between two partitioning walls 33. Thus, the BTU output of each partitioned section can be varied.

The inner housing 16 has an upper wall 34 with openings 36 for gas to flow from the product passageway 22 to gas exhaust means. The gas exhaust means comprises an exhaust passageway 38 disposed above the inner housing 16. The oven 10 further includes closure means comprising a plurality of gates 40 for selectively closing the openings 36 in the upper wall 34 of the housing to select point of draw and regulate the flow of exhaust gases therethrough. The gates 40 provide another means for controlling the amount of gas within the product passageway 22 as well as the velocity of gas flow therethrough.

Figure 1:
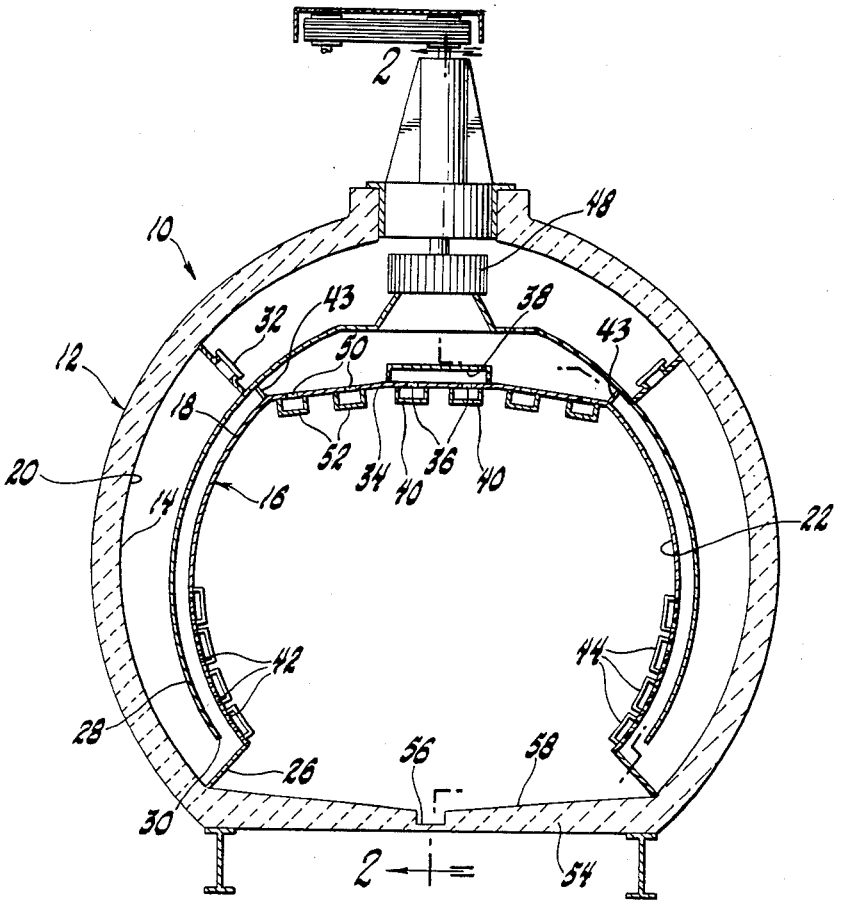
FIG. 1 is a cross sectional view taken across the product passageway of a convection type oven constructed in accordance with the invention.

The oven 10 is of a modular construction whereby a plurality of such modules can be joined together to form an oven assembly. The modules may be of a radiant or a convection type construction. A convection type module is shown FIG. 1. The inner housing 16 of the module includes side walls having perforations 42 for allowing gas flow to travel from the gas flow channel 20 into the product passageway 22. Gates 43 may be closed to prevent recirculation of the heated gases from the channel 20, thereby directing the heated gases through the perforations 42. A convection type oven is more efficient at drying after the paint has set. Combined with a low velocity gas flow, any solid particles contained within the heated gas tend to drop out by gravity either within the gas flow channel 20 or within the product passageway 22 without contaminating the painted surface of the object within the product passageway. The gates 32 may be used to vary the flow of heated gas through the oven 10 and also to restrict the gas flow channel 20 to force the heated gas through the perforations 42 and into the inner chamber of the oven 22.

Figure 3:
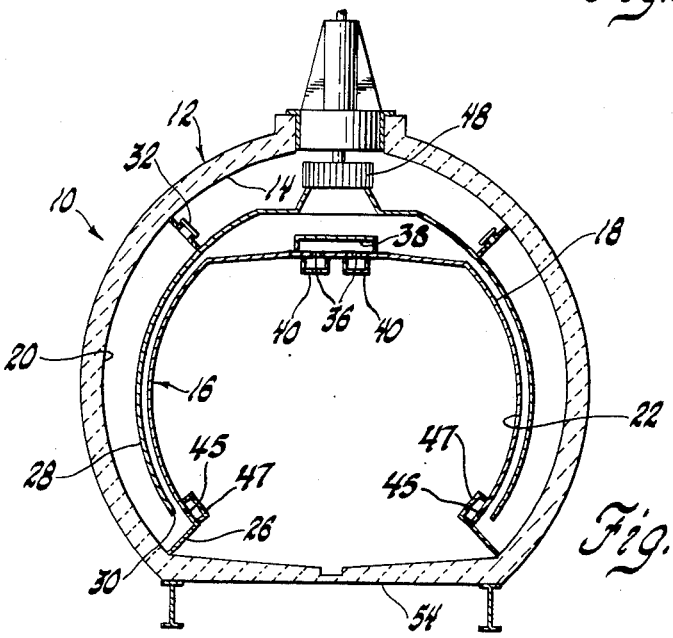
FIG. 3 is a cross sectional view taken across the product passageway of a radiant type oven constructed in accordance with the invention.

The oven 10 may further include cover means comprising a plurality of gates 44 for selectively covering various ones of the perforations 42 to block the flow of gas therethrough while allowing heat to be conducted radiantly from the gas through the gates 44 and the remainder of the inner housing 16 into the inner product passageway 22. In this manner, the convection type oven can be selectively converted into a radiant type oven. Alternatively, as shown in FIG. 3, the inner housing 16 may have solid side walls thereby functioning as a radiant type oven. Ports 45 having covers 47 may be opened to balance the gas pressures between the passageway 22 and channel 20 as gases are released to the exhaust passageway 38. This feature in combination with the ability of the oven to be converted between a radiant and convection type oven provides the assembly with great flexibility. As shown in FIG. 2, a plurality of modules can be joined together so that each zone may be a radiant or convection type as desired. It is most desirable to have a radiant oven module where the paint on the product passing therethrough is wet to protect the freshly painted product from dust particles. The convection type modules are more efficient at drying the paint once it sets. The gates 42 allow for a selective drying as they may be positioned higher on the walls or lower on the walls as desired. In other words various portions of a product may be subjected to a consentrated convection heat while others are subjected to slower radiant heat.

The oven 10 includes recirculation means for recirculating the gas flow to the gas supply means 24 for recirculation again through the oven 10. The gas supply means includes a gas heater 24 and a supply plenum 46 and a distributor fan 48 for forcing the heated gas through the supply plenum 46 and into the gas flow channel 20. The inner housing includes a second plurality of openings 50 extending through the upper wall 34 thereof to allow for recirculation of heated gases within the product passageway 22 to be circulated up to the fan 48. Adjustable members 52 are disposed over the openings to provide a further means of controlling the velocity and amount of gas flow out of the product passageway 22.

The outer housing 12 defines an oven module including connector means for connecting the oven modules to another oven module to form an oven assembly comprising a plurality of oven modules as shown in FIG. 2. Each outer housing 12 has a unitary construction with a substantially flat bottom portion 54 and arcuate side walls when viewed in cross section. The bottom portion includes a floor 58 having a downwardly sloping inner surface which leads to a central trough 56 for collecting contaminating particles therein. Since, in the convection type oven shown in FIG. 1, the perforations or openings 42 are directed upwardly and away from the bottom floor 58 of the oven 10, the heated gases flow upwardly therefrom and the solid particles settle to the floor and are not disturbed by the incoming gas flow. Such a construction provides an effective means which prevents contamination, unlike prior art assemblies wherein the gas flow picked up particles from the oven floor that would travel throughout the product passageway of the oven and contaminate the freshly painted products. The inner housing 16 has arcuate side walls when viewed in cross section extending downwardly from the gas exhaust means and the inner housing 16 has an outwardly flared bottom portion defining the bottom 26 of the gas flow channel 20. Since the side walls of the inner housing 16 are arcuate, the perforations 42 in the lower portion of the side walls of the inner housing 16 are directed upwardly and away from any contaminating particles that have settled on the floor 58 of the product passageway 22. Thus, the oven provides an additional means for preventing the contamination of freshly painted products.

The manifold wall 28 is also arcuate when viewed in cross section. The rounded side walls and inner walls of the oven 10 provide for more efficient air flow whereby the oven requires less air flow therethrough to obtain a result similar to that of prior art ovens which would require greater air flow. The oven constructed in accordance with this invention obtains a greater number of air changes per minute than prior art ovens due to this decreased requirement of air flow. Hence, the oven is more economically efficient. The rounded construction further requires less weld lines and is therefore easier to construct. It is shipped in modular units as opposed to being built in the field. Further advantages of the rounded construction are detailed in the copending United States patent application to applicant.

The invention has been described in an illustrative manner, and it is to be understood that the terminology which has been used is intended to be in the nature of words of description rather than of limitation.

Obviously many modifications and variations of the present invention are possible in light of the above teachings. It is therefore, to be understood that within the scope of the appended claims wherein reference numerals are merely for convenience and are not to be in any limiting, the invention may be practiced otherwise that is specifically described.

What is claimed is:

1. A paint bake oven (10) comprising: an outer insulated housing (12) including an inner wall surface (14); an inner housing (16) disposed within said outer housing (12) and having an outer wall surface (18) spaced from said inner wall surface (14) to define a gas flow channel (20) therebetween, said inner housing (16) having an inner product passageway (22); gas supply means (24) disposed above said inner housing (16) for supplying a gas flow to said gas flow channel (20); gas exhaust means for exhausting gas from said product passageway (22); and characterized by gas flow control means for directing the gas flow along a flow path from said gas supply means (24) downwardly along said inner wall surface (20) of said outer housing (12) and then upwardly over said outer wall surface (18) of said inner housing (16) to uniformly distribute the gas flow over said inner housing (16).

2. A paint bake oven as set forth in claim 1 further characterized by including a bottom wall (26) to define the bottom of said flow channel (20) said gas flow control means including a manifold wall (28) within said gas flow channel (20) spaced from and between said outer and inner housing (12,16) and extending downwardly from said gas supply means, said manifold wall (28) having an end portion (30) spaced from said bottom wall (26) to define said flow path.

3. A paint bake oven as set forth in claim 2 further characterized by said bottom wall (26) angling upwardly from said inner wall surface (20) of said outer housing (12) to said outer wall surface (18) of said inner housing (16).

4. A paint bake oven as set forth in claim 2 further characterized by including gating means for gating the flow of gas between said gas supply means (24) and said end portion (30) of said manifold wall (28).

5. A paint bake oven as set forth in claim 4 further characterized by said gating means including a damper (32) disposed between said manifold wall (28) and said inner wall surface (14) of said outer housing (12).

6. A paint bake oven as set forth in claim 4 further characterized by said gating means including a plurality of dampers (32) disposed along the length of said module.

7. A paint bake oven as set forth in claim 6 further characterized by including partitioning means for partitioning sections of said gas flow channel (20) along the length of said module.

8. A paint bake oven as set forth in claim 7 further characterized by said partitioning means including at least one partitioning wall (33) extending completely across said gas flow channel (20) and from said dampers (32) to said bottom wall (26) for partitioning said gas flow channel (20) into longitudinally separated sections.

9. A paint bake oven as set forth in claim 7 further characterized by said housing (16) having an upper wall (34) with openings (36) for gas flow from said product passageway (22) to said gas exhaust means (38).

10. A paint bake oven as set forth in claim 9 further characterized by including closure means (40) for selectively covering said openings (36) in said upper wall of said inner housing to regulate the flow of exhaust gases therethrough.

11. A paint bake oven as set forth in claim 7 further characterized by said inner housing (16) including side walls having perferations (42) for allowing gas flow from gas flow channel (20) into said product passageway (22).

12. A paint bake oven as set forth in claim 11 further characterized by including cover means (44) for selectively covering various ones of said perforations (42) to block the flow of gas therethrough while allowing heat to be radiantly conducted from the gas through said cover means and the remainder of said inner housing (16) into said inner product passageway (22).

13. A paint bake oven as set forth in claim 7 further characterized by including recirculation means for recirulating the gas flow to said gas supply means for recirculation through said oven (10).

14. A paint bake oven as set forth in claim 7 further characterized by said gas supply means including a gas heater (24) and a supply plenum (46) and a distributor fan (48) for forcing heated gas through said supply plenum (46) and into said gas flow channel (20).

15. A paint bake oven as set forth in claim 7 further characterized by said outer housing (12) defining an oven module including connector means for connecting said oven module to another oven module to form an oven assembly comprising a plurality of oven modules.

16. A paint bake oven as set forth in claim 7 further characterized by said outer housing (12) having a unitary construction with a substantially flat bottom (54) and arcuate side walls when viewed in cross section, said inner housing (16) having arcuate side walls when viewed in cross section extending downwardly from said gas exhaust means and having an outwardly flared bottom portion defining said bottom (26) of said flow channel (20).

17. A paint bake oven as set forth in claim 16 further characterized by said manifold wall (28) being arcuate when viewed in cross section.

* * * * *